US009375832B2

(12) United States Patent
Boeck et al.

(10) Patent No.: US 9,375,832 B2
(45) Date of Patent: Jun. 28, 2016

(54) POWER TOOL

(71) Applicant: Robert Bosch GmbH, Stuttgart (DE)

(72) Inventors: Cornelius Boeck, Kirchheim (DE); Joachim Schadow, Stuttgart (DE); Sinisa Andrasic, Schoenaich (DE); Daniel Barth, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 672 days.

(21) Appl. No.: 13/706,813

(22) Filed: Dec. 6, 2012

(65) Prior Publication Data

US 2013/0161046 A1 Jun. 27, 2013

(30) Foreign Application Priority Data

Dec. 23, 2011 (DE) ..... 10 2011 089 735

(51) Int. Cl.
*H01H 3/02* (2006.01)
*B25F 5/02* (2006.01)
*B25F 5/00* (2006.01)

(52) U.S. Cl.
CPC . *B25F 5/00* (2013.01); *B25F 5/006* (2013.01); *B25F 5/02* (2013.01)

(58) Field of Classification Search
CPC ..... H01H 3/02; H01H 3/18; H01H 2003/028; H01H 3/04; B25F 5/02
USPC ..... 173/170; 124/31, 32; 294/50.8, 50.9
See application file for complete search history.

(56) References Cited

U.S. PATENT DOCUMENTS

| | | | | |
|---|---|---|---|---|
| 4,006,784 | A * | 2/1977 | Dudek | 173/182 |
| 5,692,663 | A * | 12/1997 | Yang | 227/8 |
| 7,038,154 | B2 * | 5/2006 | Hofte et al. | 200/332 |
| 7,338,471 | B2 * | 3/2008 | Bates | 604/131 |
| 7,389,901 | B2 * | 6/2008 | Cho et al. | 227/8 |
| 7,537,065 | B2 * | 5/2009 | Gallagher et al. | 173/170 |
| 7,632,251 | B2 * | 12/2009 | Lin et al. | 604/187 |
| 7,905,482 | B2 * | 3/2011 | Matsumoto | 271/213 |
| 7,976,489 | B2 * | 7/2011 | Lawter et al. | 604/63 |
| 8,136,712 | B2 * | 3/2012 | Zingman | 227/179.1 |
| 8,283,564 | B2 * | 10/2012 | James et al. | 174/135 |
| 8,702,704 | B2 * | 4/2014 | Shelton et al. | 606/51 |
| 2008/0109005 | A1 * | 5/2008 | Trudeau | A61F 2/4425 606/99 |
| 2010/0071218 | A1 * | 3/2010 | Poole | F41A 17/06 30/233 |
| 2012/0203269 | A1 * | 8/2012 | Katsuki et al. | 606/205 |

FOREIGN PATENT DOCUMENTS

DE 197 07 215 A1 9/1997

* cited by examiner

*Primary Examiner* — Gloria R Weeks
(74) *Attorney, Agent, or Firm* — Maginot, Moore & Beck LLP

(57) ABSTRACT

A power tool, in particular an angle grinder, includes at least one switching unit which has at least one pivotably mounted pawl element. The pawl element defines a pivot axis. The pawl element is mounted so as to pivot about the pivot axis of the pawl element through an angular range greater than 30°.

14 Claims, 5 Drawing Sheets

POWER TOOL

This application claims priority under 35 U.S.C. §119 to patent application no. DE 10 2011 089 735.6, filed on Dec. 23, 2011 in Germany, the disclosure of which is incorporated herein by reference in its entirety.

BACKGROUND

A power tool, in particular an angle grinder, which comprises a switching unit that has a pivotably mounted pawl element is already known from DE 197 07 215 A1.

SUMMARY

The disclosure proceeds from a power tool, in particular from an angle grinder, having at least one switching unit that has at least one pivotably mounted pawl element.

It is proposed that the pawl element be mounted such as to be pivotable about a pivot axis of the pawl element through an angular range greater than 30°. The power tool is preferably in the form of a portable power tool, in particular of a portable, hand-held power tool. A "portable power tool" should be understood here as meaning in particular a power tool for machining workpieces, it being possible for an operator to transport said power tool without a transporting machine. The portable power tool has in particular a mass which is less than 40 kg, preferably less than 10 kg and particularly preferably less than 7 kg. The portable power tool is particularly preferably in the form of an angle grinder. However, it is also conceivable for the portable power tool to have some other form that appears appropriate to a person skilled in the art, such as for example the form of a rotary and/or demolition hammer, a drilling machine, a saber saw, a jigsaw, a hedge trimmer, etc. The term "switching unit" is intended to define here in particular a unit which has at least one component, in particular the pawl element, that can be actuated directly by an operator, said unit being provided to influence and/or alter a process and/or a state of a unit coupled to the switching unit by actuation and/or by the input of parameters. The pawl element is preferably provided for actuating at least one switching element of the switching unit. Preferably, the switching unit is provided to actuate the switching element by means of actuation of the pawl element, in order to open or close a circuit for supplying power to at least one drive unit of the power tool. Thus, the switching unit is preferably provided to allow the power tool to be started up or deactivated. The term "provided" should be understood as meaning in particular specially configured and/or specially equipped. The switching element is formed preferably by a mechanical, electric and/or electronic switching element.

A "pawl element" should be understood here in particular as meaning an operating element which has a longitudinal extent, in a longitudinal extent direction of the operating element, which is greater than a transverse extent, extending at least substantially perpendicularly to the longitudinal extent direction, of the operating element, said transverse extent extending at least substantially transversely to a direction of movement of the operating element. Preferably, a maximum longitudinal extent of the pawl element is at least two times greater, preferably at least 2.5 times greater and particularly preferably at least three times greater than a maximum transverse extent of the pawl element. The pawl element preferably comprises an operating surface which, in a mounted state of the pawl element, extends at least over the majority of a maximum transverse extent of a shaft-like gripping region of a handle housing of the power tool. Preferably, the operating surface of the pawl element extends at least over more than 60%, preferably over more than 65% and preferably over more than 70% of a maximum transverse extent of a gripping surface of the shaft-like gripping region of the handle housing, said gripping surface facing the pawl element in at least one operating state. The expression "substantially perpendicularly" is intended to define here in particular an orientation of a direction in relation to a reference direction, wherein the direction and the reference direction, in particular when seen in a plane, enclose an angle of 90° and the angle has a maximum deviation of in particular less than 8°, advantageously less than 5° and particularly advantageously less than 2°. By means of the configuration according to the disclosure of the power tool, high comfort during use of the power tool can advantageously be achieved.

Furthermore, it is proposed that the pawl element is mounted such as to be pivotable about the pivot axis through an angular range greater than 60°. Preferably, the pawl element is mounted such as to be pivotable about the pivot axis through an angular range of about 90°. Particularly preferably, the pawl element is provided to actuate the switching element starting from a deflection about the pivot axis through an angular range of more than 70°. It is thus advantageously possible to achieve high security against unintentional actuation of the switching element, which can be actuated by means of a movement of the pawl element about the pivot axis, as a result of a large actuation travel of the pawl element. It is advantageously possible to dispense with an additional switch-on inhibitor of the pawl element in order to avoid unintentional actuation of the switching element by means of the pawl element. It is thus advantageously possible to save components, installation space and costs. As a result, it is advantageously possible to create a compact power tool.

Furthermore, it is proposed that the power tool comprises at least the handle housing which has at least one gripping surface, wherein at least one handle lever region of the pawl element is arranged outside the gripping surface in at least one operating state. A "handle housing" should be understood here in particular as meaning at least a housing or at least a housing sub-region, which is as far as possible decoupled from a bearing arrangement of a drive unit and/or output unit of the power tool, wherein at least a gripping region of the housing or of the housing sub-region, in particular a housing sub-region in the form of a shaft-like gripping region, is at least largely graspable by an operator in order to handle the power tool with at least one hand. The expression "largely graspable" is intended to define here in particular a graspability of a component or of a component region by means of a hand of an operator along at least more than 70%, preferably more than 80% and particularly preferably more than 90% of an overall extent of an overall outer circumference of the component or of the component region, said overall outer circumference extending in a plane that extends at least substantially perpendicularly to a longitudinal extent direction of the component or of the component region, wherein the overall extent of the overall circumference is in particular less than 40 cm, preferably less than 30 cm and particularly preferably less than 25 cm. Preferably, when the component or component region is grasped, a hand inner surface and finger inner surfaces of the operator's hand rest against the overall outer circumference at least along a length greater than 70%, preferably greater than 80% and particularly preferably greater than 90% of the overall extent of the overall outer circumference.

Preferably, the handle housing is formed separately from a drive housing of the power tool, said drive housing being provided to accommodate the drive unit and/or output unit in order to support drive and/or output bearing forces. However, it is also conceivable for the handle housing and the drive housing to be formed in one piece. Preferably, the shaft-like gripping region is arranged in a manner inclined at least at an angle less than 60°, preferably less than 40° and particularly preferably less than 30° in relation to a main extent direction of the power tool. Preferably, the shaft-like gripping region is arranged behind the drive unit, as seen along a rotation axis of a drive element, in particular an armature shaft, of a drive unit of the power tool and in particular along the main extent direction of the power tool. In addition, it is conceivable for the handle housing, in addition to the shaft-like gripping region, to have a bracket-like sub-region which is integrally formed on the shaft-like gripping region. The bracket-like sub-region can preferably have an L-shaped form which extends from an end of the shaft-like gripping region, said end being remote from the attachment region of the handle housing, in an L-shaped manner in the direction of the attachment region. Particularly preferably, the handle housing comprises at least two handle housing shell elements which can be connected together in a connecting plane. Thus, the handle housing preferably has a shell-like structure. However, it is also conceivable for the handle housing to have a pot-like structure.

A "gripping surface of the handle housing" should be understood here in particular as meaning a surface of the handle housing that is gripped or grasped by an operator by way of a hand or fingers of the hand in order to operate or handle the power tool, for example during the machining of a workpiece by means of the power tool. The gripping surface of the handle housing is preferably arranged on the shaft-like gripping region of the handle housing, in particular on a side facing the pawl element. The shaft-like gripping region of the handle housing forms preferably a main handle of the power tool. The expression "arranged outside the gripping surface" is intended to define here in particular an arrangement of the pawl element, in particular of the handle lever region of the pawl element, in relation to the gripping surface, wherein the pawl element, in particular the handle lever region of the pawl element, is arranged in a manner spaced apart from the gripping surface. A "handle lever region" should be understood here in particular as meaning a region of the pawl element that is gripped by an operator in order to actuate the pawl element by way of at least one finger of a hand of the operator. By means of the configuration according to the disclosure, security against unintentional operation can advantageously be further increased in comparison with high security on account of the pivotable mounting of the pawl element through an angular range greater than 60°, in particular during transport of the power tool, in which the operator grasps the gripping surface and it is undesired for the power tool to start up.

Advantageously, the power tool comprises at least the handle housing which has a main extent direction, to which the pivot axis extends at least substantially transversely. "Substantially transversely" should be understood here in particular as meaning an orientation of a direction and/or of an axis in relation to a reference direction and/or a reference axis, wherein the orientation of the direction and/or of the axis is at least different from an at least substantially parallel orientation with respect to the reference direction and/or to the reference axis and is in particular skewed or perpendicular with respect to the reference direction and/or to the reference axis. The main extent direction of the handle housing preferably extends at least substantially parallel to the main extent direction of the power tool. Preferably, the main extent direction of the handle housing is identical to the main extent direction of the power tool. Particularly preferably, the pivot axis of the pawl element extends at least substantially perpendicularly to a main extent direction of the power tool. In this case, the pivot axis preferably extends at least substantially perpendicularly to a movement plane of the pawl element, in which plane at least one direction of movement component of the pawl element extends. Preferably, the pivot axis extends at least substantially perpendicularly to the connecting plane of the shell elements of the handle housing. The pivot axis of the pawl element is preferably arranged on a side, facing an attachment region, of the handle housing. The expression "attachment region" is intended to define here in particular a region of the handle housing, via which the handle housing is connected in a form-fitting, force-fitting and/or materially integral manner to the drive housing, or by way of which the handle housing bears directly against the drive housing. By means of the configuration according to the disclosure, a compact arrangement of the pawl element on the handle housing can advantageously be achieved.

Preferably, the power tool comprises at least the handle housing, which has at least one gripping surface, wherein the pawl element bears at least partially against the gripping surface in at least an actuated state. Comfortable holding of the pawl element in an actuated state of the pawl element can advantageously be achieved. Furthermore, a mechanical stop for limiting a movement of the pawl element about the pivot axis can be achieved in a structurally simple manner.

In addition, it is proposed that the switching unit has at least one spring unit for realizing a degressive spring force profile, said spring unit being provided at least to bias the pawl element in the direction of a starting position of the pawl element by a spring force. In this case, the degressive spring force profile can be realized by means of an appropriately configured spring element of the spring unit or by means of an appropriately configured transmission mechanism, in particular by means of a lever transmission mechanism. A low holding force for holding the pawl element in an actuated state of the pawl element can advantageously be achieved. Thus, high comfort during use can advantageously be achieved. In this case, in particular, fatigue of an operator as a result of holding the pawl element can advantageously be kept low. In addition, by means of the spring unit, a dead-man's switch, which effects a restoring movement of the pawl element into a starting position after an operator stops exerting force in order to actuate the pawl element, can advantageously be realized.

Advantageously, the spring unit comprises at least one spring element which is arranged, in a mounted state, with one end in an actuating lever region of the pawl element, said actuating lever region being provided to actuate the switching element of the switching unit in at least one state. A "spring element" should be understood in particular as meaning a macroscopic element which has at least an extent that, in a normal operating state, can be elastically changed by at least 10%, in particular by at least 20%, preferably by at least 30% and particularly advantageously by at least 50%, and generates in particular an opposing force that is dependent on a change in the extent, is preferably proportional to the change and counteracts the change. A "macroscopic element" should be understood in particular to mean an element having an extent of at least 1 mm, in particular of at least 5 mm and preferably of at least 10 mm A dead-man's switch can be realized in a structurally simple manner.

Advantageously, the spring element is in the form of a tension spring. However, it is also conceivable for the spring element to have some other form that appears to be appropriate to a person skilled in the art, for example the form of a compression spring, torsion spring, etc. By means of the configuration according to the disclosure, a degressive spring force profile can advantageously be achieved, and a restoring function of the pawl element can advantageously be enabled in a structurally simple manner.

Furthermore, it is proposed that the pawl element has at least the actuating lever region for actuating a switching element, said actuating lever region extending from the pivot axis in a direction away from the handle lever region of the pawl element. A lever principle can advantageously be used to actuate the switching element of the switching unit. In this way, an advantageous force transmission can be achieved.

In addition, it is proposed that the power tool has at least one damping unit which is provided to damp at least an impact of the pawl element in the event of a movement of the pawl element from an actuated state of the pawl element into a starting position of the pawl element. A "damping unit" should be understood here in particular to mean a unit which is provided specifically to convert one form of energy, in particular movement energy of the actuating element, into another form of energy, in particular thermal energy, and is provided in particular to produce a braking force which goes substantially, i.e. in particular by more than 50% and particularly preferably by more than 100%, beyond a braking force which is brought about by a friction force required purely for mounting. The damping unit can in this case comprise at least one elastomeric damping element against which the pawl element bears in the event of a movement from an actuated state into a starting position. It is likewise conceivable for the damping unit to have at least one pressure damper element, for example an oil or air pressure damper, which damps a movement of the pawl element from an actuated state into a starting position. Further configurations of the damping unit that appear to be appropriate to a person skilled in the art are likewise conceivable. By means of the configuration according to the disclosure, handling of the power tool that does not adversely affect the components can advantageously be achieved. In addition, high comfort during use can be achieved for an operator who can operate the power tool at least as far as possible without impact noises of the pawl element in the event of a movement of the pawl element from an actuated state into a starting position.

Furthermore, the disclosure proceeds from a power tool switching device of a power tool according to the disclosure, wherein the power tool switching device comprises at least the switching unit. In addition, it is conceivable for the power tool switching device to have at least one bearing unit for mounting the pawl element in a movable manner. The bearing unit can in this case be in the form of a translational bearing unit, a rotational bearing unit or a combination of a translational bearing unit and a rotational bearing unit, for example a lever mechanism bearing unit, etc. Simple retrofitting of already existing power tools with the switching unit according to the disclosure can thus advantageously be achieved.

The power tool according to the disclosure and/or the power tool switching device according to the disclosure is/are not in this case intended to be restricted to the above-described application and embodiment. In particular, the power tool according to the disclosure and/or the power tool switching device according to the disclosure can have a number of individual elements, components and units that deviates from a number mentioned herein in order to fulfill a mode of operation described herein.

BRIEF DESCRIPTION OF THE DRAWINGS

Further advantages can be gathered from the following description of the drawing. The drawing illustrates an exemplary embodiment of the disclosure. The drawing and the description contain numerous features in combination. A person skilled in the art will also expediently consider the features individually and combine them into appropriate further combinations.

In the drawing.

DETAILED DESCRIPTION

Figure 1:
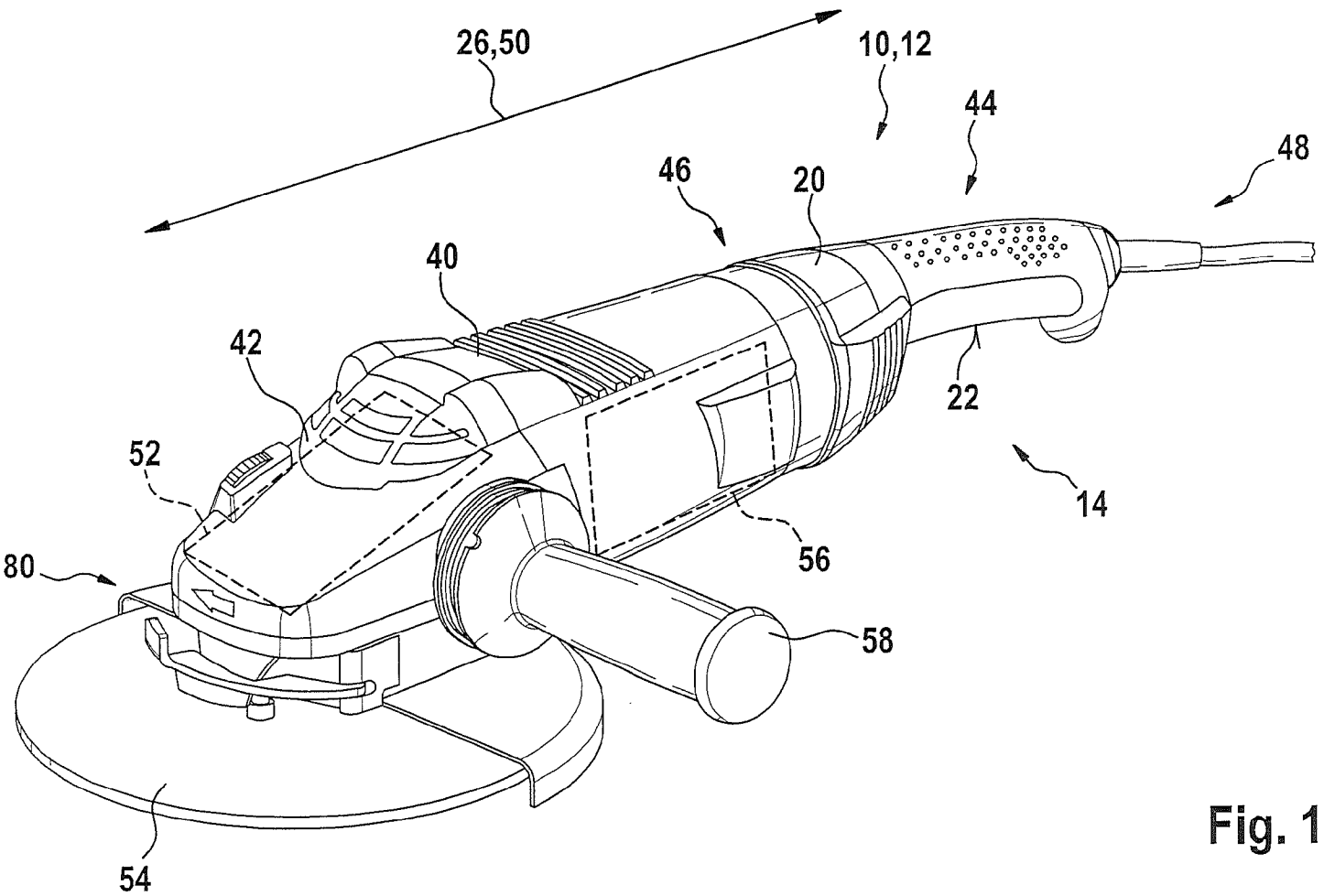
FIG. 1 shows a schematic illustration of a power tool according to the disclosure.
Figure 2:
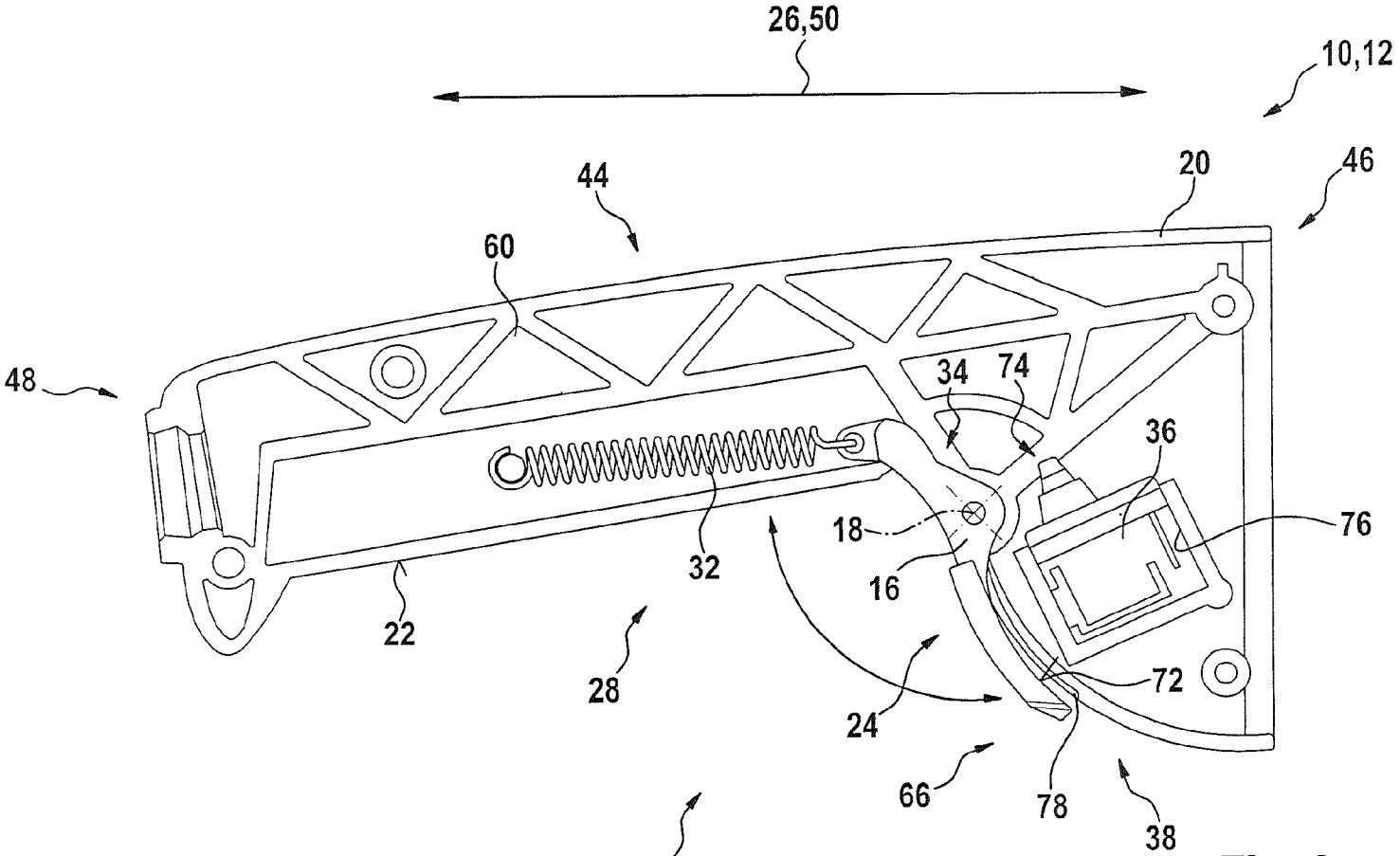
FIG. 2 shows a schematic illustration of a detail of a switching unit of the power tool in an unactuated state with a removed shell element of a handle housing of the power tool according to the disclosure.

FIG. 1 shows a power tool 10 which is formed by a portable power tool 10 in the form of an angle grinder 12. The portable power tool 10 comprises at least one switching unit 14 which has at least one pivotably mounted pawl element 16 for actuating at least one switching element 36 of the switching unit 14 (FIG. 2). In this case, the portable power tool 10 has at least one power tool switching device which comprises at least the switching unit 14. The portable power tool 10 in the form of an angle grinder 12 further comprises a protective hood unit 80, a handle housing 20, a drive housing 40 and an output housing 42. A shaft-like gripping region 44 of the handle housing 20 in this case forms a main handle of the portable power tool 10. The main handle extends at least substantially from an attachment region 46 of the handle housing 20, in a direction away from the attachment region 46, as far as a side 48 of the handle housing 20 at which a cable of the portable power tool 10 in the form of an angle grinder 12 is arranged for power supply. The shaft-like gripping region 44 of the handle housing 20 is arranged in a manner inclined at an angle less than 30° in relation to a main extent direction 26 of the handle housing 20 or in relation to a main extent direction 50 of the portable power tool 10.

Out of the output housing 42 there extends an output shaft, in the form of a spindle (not shown in more detail here), of an output unit 52 of the portable power tool 10, to which a machining tool 54 for machining a workpiece (not illustrated in more detail here) can be fixed. The machining tool 54 is in the form of a grinding disk. However, it is also conceivable for the machining tool 54 to be in the form of a cut-off disk or polishing disk. The portable power tool 10 comprises the drive housing 40 for accommodating a drive unit 56 of the portable power tool 10 and the output housing 42 for accommodating the output unit 52. The drive unit 56 is provided to drive the machining tool 54 in rotation via the output unit 52. The machining tool 54 can in this case be connected to the spindle, so as to rotate therewith, by means of a fastening element (not illustrated in more detail here) in order to machine a workpiece. Thus, the machining tool 54 can be driven in rotation when the portable power tool 10 is in operation. The output unit 52 is connected to the drive unit 56, in a manner already known to a person skilled in the art, via a drive element (not illustrated in more detail here) of the drive unit 56, said drive element being in the form of a pinion and being drivable in rotation. In addition, an auxiliary handle 58 is arranged on the output housing 42. The auxiliary handle 58 extends, in a state mounted on the output housing 42, transversely to the main extent direction 50 of the portable power tool 10.

FIG. 2 shows a detail of the switching unit 14 which has the movably mounted pawl element 16 for actuating the switching element 36. The pawl element 16 is mounted such as to be pivotable about a pivot axis 18 of the pawl element 16 through an angular range greater than 30°. The pawl element 16 is mounted pivotably on the handle housing 20. In this case, the pawl element 16 is mounted such as to be pivotable about the pivot axis 18 through an angular range greater than 60°. The pawl element 16 is mounted such as to be pivotable about the pivot axis 18 from a starting position through an angular range of about 90°. The starting position of the pawl element 16 corresponds to an unactuated state of the pawl element 16. Thus, the pawl element 16 in the starting position is at least substantially decoupled from a direct exertion of force by an operator on the pawl element 16.

Figure 3:
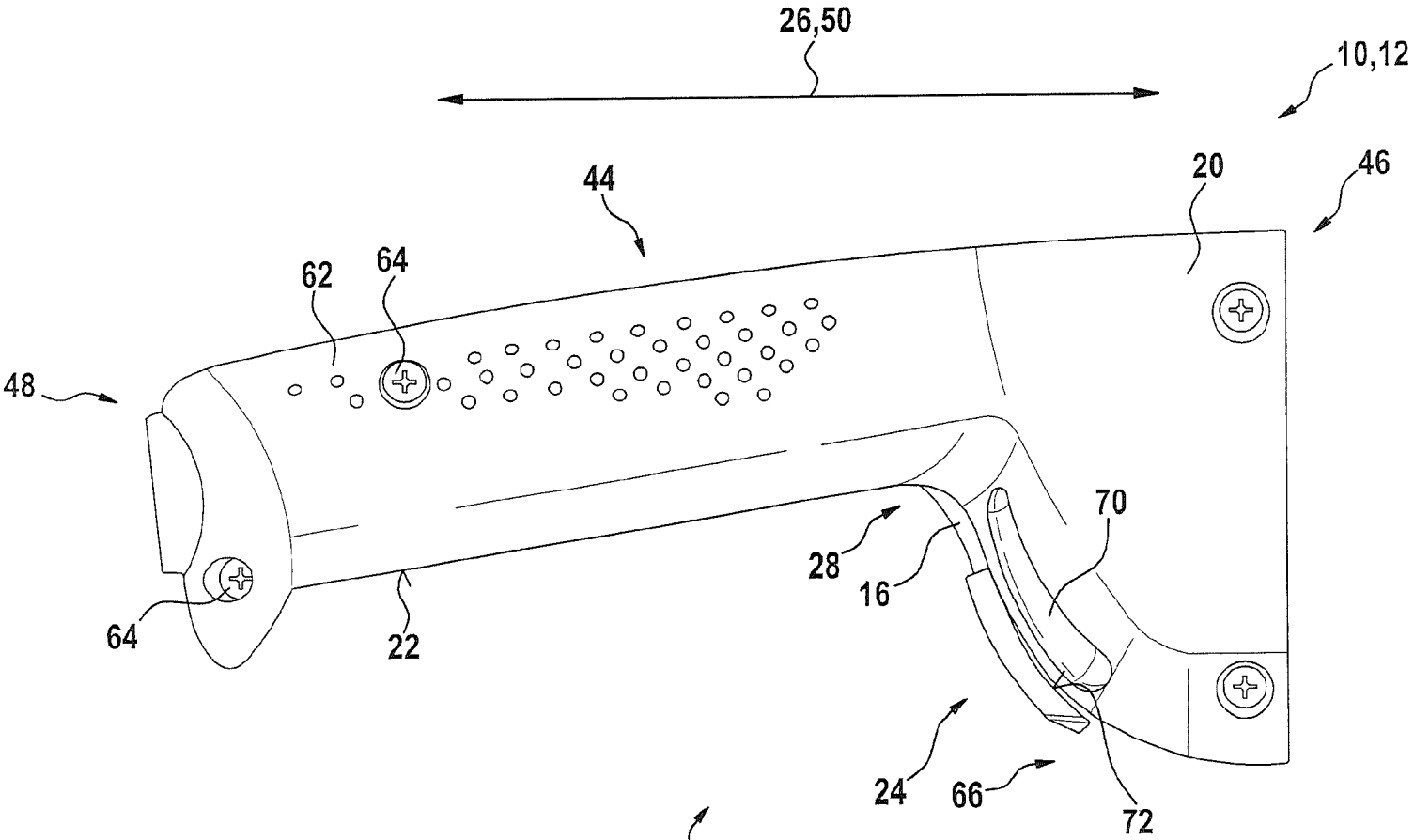
FIG. 3 shows a schematic illustration of a further detail of the switching unit in an unactuated state in a mounted state of the handle housing shell element.
Figure 6:
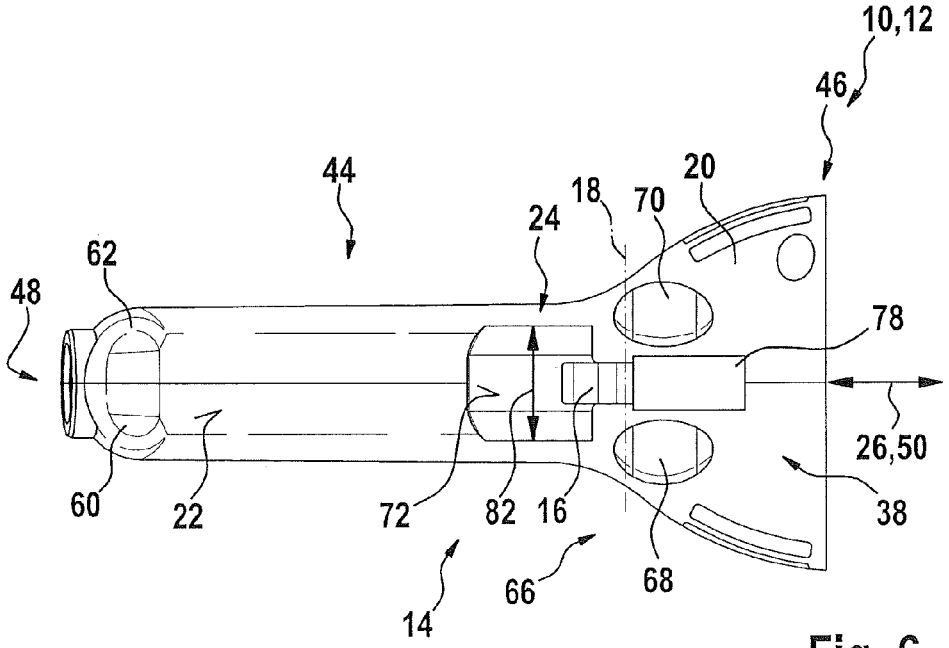
FIG. 6 shows a schematic illustration of a detail of a pawl element, arranged on the handle housing, of the switching unit in an actuated state.

Furthermore, the handle housing 20 comprises at least one gripping surface 22, wherein at least one handle lever region 24 of the pawl element 16 is arranged outside the gripping surface 22 in at least one operating state (FIG. 3). In this case, the handle lever region 24 of the pawl element 16 is arranged outside the gripping surface 22 in the starting position of the pawl element 16. The gripping surface 22 is arranged on the shaft-like gripping region 44 which forms the main handle of the portable power tool 10. Thus, the handle lever region 24 is arranged in a manner spaced apart from the gripping surface 22 in the starting position of the pawl element 16. The handle lever region 24 is provided to be contacted directly by an operator in order to actuate the pawl element 16. In order to actuate the pawl element 16, the operator grips the handle lever region 24 with at least one finger of a hand of the operator and pivots the pawl element 16 about the pivot axis 18. On a side 66 facing the handle lever region 24 in the starting position of the pawl element 16 and remote from the attachment region 46, the handle housing 20 has at least two gripping hollows 68, 70 (FIG. 6). In the starting position of the pawl element 16, the handle lever region 24 at least partially rests, by way of a side facing the attachment region 46, against that side 66 of the handle housing 20 on which the gripping hollows 68, 70 are arranged. The gripping hollows 68, 70 are thus provided to allow an operator to comfortably grip the handle lever region 24 in the starting position of the pawl element 16. Thus, an operator can pivot the pawl element 16 about the pivot axis 18 from the starting position by means of exertion of force on the handle lever region 24.

The pivot axis 18 of the pawl element 16 extends at least substantially transversely to the main extent direction 26 of the handle housing 20 or to the main extent direction 50 of the portable power tool 10. In this case, the pivot axis 18 extends at least substantially perpendicularly to the main extent direction 26 of the handle housing 20 or to the main extent direction 50 of the portable power tool 10. The main extent direction 26 of the handle housing 20 extends in a connecting plane (in FIG. 2, the connecting plane is formed by the plane of the sheet) in which two shell elements 60, 62 of the handle housing 20 (FIG. 6) are connected together in a mounted state. The pivot axis 18 thus extends at least substantially perpendicularly to the connecting plane. The two handle housing shell elements 60, 62 are fixed to one another by means of connecting elements 64, for example screws, bolts, etc. (FIG. 3).

Figure 5:
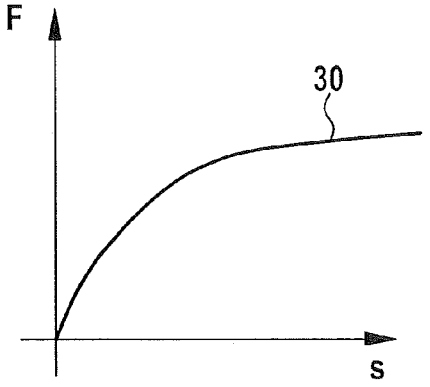
FIG. 5 shows a diagram of a spring force profile that can be realized by means of a spring unit of the switching unit, wherein an actuation force F is plotted over an actuation travel s.

Furthermore, the switching unit 14 has at least one spring unit 28 for realizing a degressive spring force profile 30 (FIG. 5), said spring unit 28 being provided at least to bias the pawl element 16 in the direction of the starting position of the pawl element 16 with a spring force. Thus, the spring unit 28 is provided to realize a dead-man's switch, which, starting from an actuated state of the pawl element 16, automatically restores the pawl element 16 into the starting position of the pawl element 16 after an operator stops exerting force on the pawl element 16. To this end, the spring unit 28 has at least one spring element 32. The spring element 32 is in the form of a tension spring. Furthermore, the spring element 32 is arranged, in a mounted state, with one end in an actuating lever region 34 of the pawl element 16, said actuating lever region 34 being provided to actuate the switching element 36 of the switching unit 14 in at least one state. By way of a further end, the spring element 32 is fixed to one of the handle housing shell elements 60, 62. The actuating lever region 34 for actuating the switching element 36 of the switching unit 14 extends from the pivot axis 18 in a direction away from the handle lever region 24 of the pawl element 16.

The handle lever region 24 comprises at least one actuating surface 72, which has a longitudinal extent that extends at least substantially perpendicularly to the pivot axis 18. The maximum longitudinal extent of the handle lever region 24 corresponds at least substantially to 30% of a maximum longitudinal extent, as seen along the main extent direction 26 of the handle housing 20, of he gripping surface 22 of the shaft-like gripping region 44 (FIG. 6). In addition, the actuating surface 72 has a maximum transverse extent which extends in a transverse extent direction 82 of the pawl element 16 and corresponds to at least substantially 70% of a maximum transverse extent, extending at least substantially parallel to the pivot axis 18, of the gripping surface 22 of the shaft-like gripping region 44. The transverse extent direction 82 extends at least substantially parallel to the pivot axis 18.

Figure 4:
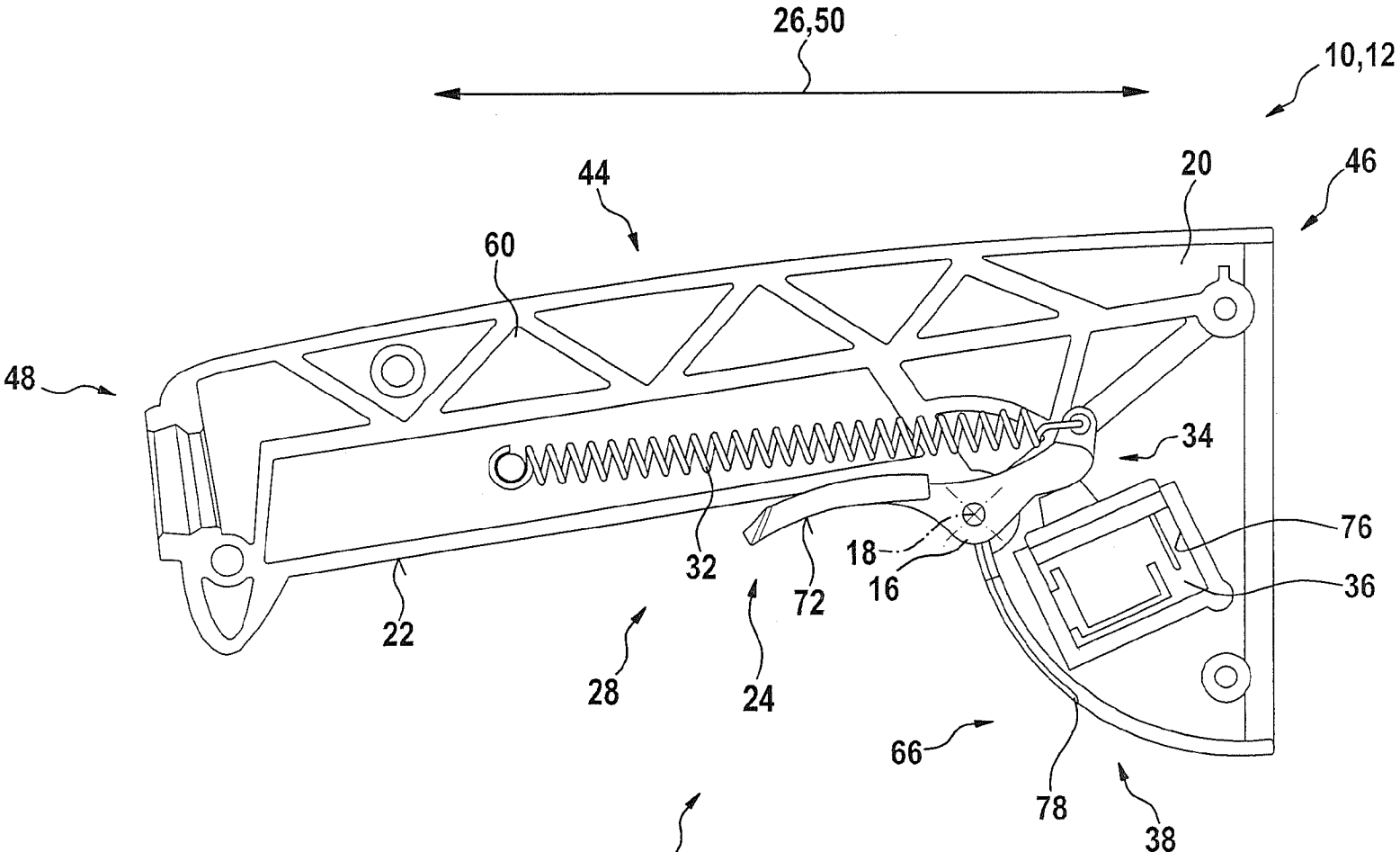
FIG. 4 shows a schematic illustration of a detail of the switching unit in an actuated state with a removed shell element of the handle housing.

The pawl element 16 rests, in at least an actuated state, at least partially against the gripping surface 22 (FIG. 4). In this case, the handle lever region 24 of the pawl element 16 rests at least partially against the gripping surface 22 of the shaft-like gripping region 44 of the handle housing 20. In an actuated state of the pawl element 16, in which state the pawl element 16 is pivoted about the pivot axis 18 by an operator at least through an angular range of more than 80°, the actuating lever region 34 begins to actuate an actuating region 74, in the form of a switching plunger, of the switching element 36. As soon as the handle lever region 24 butts against the gripping surface 22 as a result of a pivoting movement of the pawl element 16 about the pivot axis 18, the actuating region 74 in the form of a switching plunger is fully actuated and thus closes an electric circuit to power the drive unit 56 so as to start up the portable power tool 10. The switching element 36 is arranged fixedly in a holding recess 76 at least in one of the handle housing shell elements 60, 62.

Furthermore, the portable power tool 10 has at least one damping unit 38, which is provided to damp at least an impact of the pawl element 16 when the pawl element 16 is moved from an actuated state of the pawl element 16 into the starting position of the pawl element 16. The pawl element 16 moves from a position in an actuated state into the starting position of the pawl element 16 as a result of an operator stopping exertion of force on the pawl element 16 and as a result of a spring force of the spring element 32 of the spring unit 28. As a result of a movement from a position in an actuated state into the starting position, the pawl element 16 comes into direct contact with at least one damping element 78 of the damping unit 38. The damping element 78 is provided to damp a movement of the pawl element 16 in the direction of the starting position. In this case, the damping element 78 is arranged on that side 66 of the handle housing 20 that is remote from the attachment region 46. As seen in a direction that extends at least substantially parallel to the pivot axis 18, the damping element 78 is arranged between the gripping hollows 68, 70 (FIG. 6). Furthermore, the damping element 78 is in the form of an elastomeric damping element. However, it is also conceivable for the damping element 78 to have some other form that appears to be appropriate to a person skilled in the art.

In an alternative embodiment (not shown in more detail here) of the portable power tool 10, it is conceivable for the portable power tool 10 to have an electric and/or electronic start-up inhibitor which, for example, only allows the drive unit 56 to be powered once a sensor unit of the portable power tool 10 senses contact of a further hand of an operator with the auxiliary handle 58 in addition to contact of a hand with the handle housing 20, in particular the shaft-like gripping region 44, and thus deactivates the electric and/or electronic start-up inhibitor via an open-loop and/or closed-loop control unit, which evaluates and processes the sensed variables, in order to allow the portable power tool 10 to be started up.

What is claimed is:

1. A power tool switching device comprising:

at least one switching unit that includes:

a switching element; and at least one pawl element that is mounted so as to pivot about a pivot axis through an angular range greater than 30°, the pivot axis being offset with respect to the switching element, and the at least one pawl element having:

at least one handle lever region that extends perpendicularly to the pivot axis; and an actuating lever region that extends in a direction opposite the at least one handle lever region with respect to the pivot axis, the at least one pawl element being configured such that when the at least one pawl element is pivoted about the pivot axis to move the at least one handle lever region away from the at least one switching unit, the actuating lever region moves toward an actuating position to actuate the switching element.

2. The power tool switching device according to claim 1, wherein the angular range is greater than 60°.

3. The power tool switching device according to claim 1, further comprising:

at least one spring unit configured to generate a degressive spring force profile, said at least one spring unit configured to bias the at least one pawl element so as to move the actuating lever region in a direction away from the actuating position by a spring force.

4. The power tool switching device according to claim 3, wherein the at least one spring unit has at least one spring element arranged, in a mounted state, with one end at the actuating lever region of the at least one pawl element.

5. The power tool according to claim 4, wherein the at least one spring element is a tension spring.

6. A power tool comprising:

a handle housing that defines:

at least one gripping surface that extends along a main extent of the power tool; and a side that extends transversely to the at least one gripping surface; and at least one switching unit that includes:

at least one pawl element that is pivotably mounted to the side of the handle housing so as to pivot about a pivot axis perpendicular to a plane defined by the at least one gripping surface and the side of the handle housing, the at least one pawl element being pivotable from a resting position whereat the at least one pawl element is positioned at the side of the handle housing and an actuation position whereat the at least one pawl is spaced apart from the side of the handle housing towards the at least one gripping surface, wherein the actuation position is separated from the resting position by an angular range greater than 30°, and wherein the handle housing further defines at least two gripping hollows on opposite sides of the plane perpendicular to the pivot axis that enable a user to grip the at least one pawl element when the pawl element is in the resting position.

7. The power tool according to claim 6, wherein the angular range greater than 60°.

8. The power tool according to claim 6, wherein at least one handle lever region of the at least one pawl element is arranged outside the at least one gripping surface in at least one operating state.

9. The power tool according to claim 8, wherein the at least one pawl element bears at least partially against the at least one gripping surface in at least an actuated state.

10. The power tool according to claim 6, wherein the switching unit further includes at least one spring unit configured to generate a degressive spring force profile, said at least one spring unit configured to bias the at least one pawl element in a direction of the resting position of the at least one pawl element by a spring force.

11. The power tool according to claim 10, wherein the at least one spring unit has at least one spring element arranged, in a mounted state, with one end in an actuating lever region of the at least one pawl element, said actuating lever region configured to actuate a switching element of the at least one switching unit in at least one state.

12. The power tool according to claim 11, wherein the at least one spring element is a tension spring.

13. The power tool according to claim 6, wherein the at least one pawl element has at least one actuating lever region configured to actuate a switching element of the switching unit, said at least one actuating lever region extending from the pivot axis in a direction away from a handle lever region of the at least one pawl element.

14. The power tool according to claim 6, further comprising:

at least one damping unit positioned at the side of the handle housing, and configured to damp at least an impact of the at least one pawl element against the side of the handle housing when the at least one pawl element moves from an actuated position into the resting position.

* * * * *